US006688912B2

(12) United States Patent
Eastman et al.

(10) Patent No.: US 6,688,912 B2
(45) Date of Patent: Feb. 10, 2004

(54) DEVICE AND METHOD FOR CONNECTING WIRE

(75) Inventors: Abraham Eastman, Goodlettsville, TN (US); David Murray, Hendersonville, TN (US); Brent Myers, Springfield, TN (US); Terry Oquin, Nashville, TN (US); Robert Sexton, Hendersonville, TN (US)

(73) Assignee: DeCorp Americas, Inc., Hendersonville, TN (US)

( * ) Notice: Subject to any disclaimer, the term of this patent is extended or adjusted under 35 U.S.C. 154(b) by 0 days.

(21) Appl. No.: 10/073,858

(22) Filed: Feb. 14, 2002

(65) Prior Publication Data

US 2003/0153208 A1 Aug. 14, 2003

(51) Int. Cl.[7] ..... H01R 12/24
(52) U.S. Cl. ..... 439/498; 439/725
(58) Field of Search ..... 439/492, 499, 439/493, 494, 495, 496, 497, 498, 790, 835, 838, 860, 864, 409, 410, 725, 407, 164, 4, 778, 779, 780

(56) References Cited

U.S. PATENT DOCUMENTS

| | | | | | |
|---|---|---|---|---|---|
| 2,388,724 | A | * | 11/1945 | Cornella | 439/783 |
| 2,553,341 | A | * | 5/1951 | Stonehill | 439/864 |
| 3,416,763 | A | * | 12/1968 | Moreno | 24/68 R |
| 3,605,073 | A | * | 9/1971 | Vetter | 439/67 |
| 3,675,182 | A | * | 7/1972 | Gregory | 439/426 |
| 3,877,773 | A | * | 4/1975 | Doty et al. | 439/406 |
| 4,186,984 | A | * | 2/1980 | Reavis et al. | 439/460 |
| 4,214,733 | A | * | 7/1980 | Bruckl et al. | 439/725 |
| 4,215,909 | A | * | 8/1980 | Olsen | 439/409 |
| 5,254,015 | A | * | 10/1993 | Robertson | 439/410 |
| 5,468,159 | A | * | 11/1995 | Brodsky et al. | 439/501 |
| 5,984,717 | A | * | 11/1999 | Lee | 439/501 |

* cited by examiner

*Primary Examiner*—Ross Gushi
(74) *Attorney, Agent, or Firm*—McGinn & Gibb, PLLC

(57) ABSTRACT

A device for connecting wire includes a conductive rod having a first slot for inserting a conductor of a wire, and an insulating sleeve covering a portion of the conductive rod, the insulating sleeve having a second slot through which the conductor contacts the conductive rod.

29 Claims, 10 Drawing Sheets

SECTION I–I

SECTION I-I

DEVICE AND METHOD FOR CONNECTING WIRE

BACKGROUND OF THE INVENTION

1. Field of the Invention

The present invention generally relates to a device and method for connecting wire, and more particularly to a device and method for connecting wire, which may be used to connect a flat wire.

2. Description of the Related Art

Conventional wire connections are typically made by means of a conductive material slightly conformed and placed within a close proximity. Such connections utilize various forms of fastening to create pressure for the desired effect of mechanical stability.

However, there are inherent problems with such arrangements which include varying contact resistance upon installation, changing contact resistance over time, loss of signal, corrosion, difficulty of installation, and disconnection under various mechanical conditions.

In addition, conventional wire is typically in the form of a wire strand or a plurality of wire strands. Such wire is incompressible and must be formed by the user to properly fasten to a connector. However, even after being formed in some fashion, such wire typically does not make good surface contact. Indeed, to improve the surface contact, the wires are often welded or soldered to the connector. However, this is extremely burdensome, time consuming and costly. Moreover, welding or soldering the wire to the connector makes the connection irreversible.

SUMMARY OF THE INVENTION

In view of the foregoing problems of the conventional techniques, an object of the present invention is to provide a device and method for connecting wire which provides a secure, durable, large-surface area contact connection mechanism and which may be used to connect flat wire.

In a first aspect of the present invention, a device for connecting wire includes a conductive rod having a first slot for inserting a conductor (e.g., plurality of conductors) of a wire (e.g., plurality of wires), and an insulating sleeve covering a portion of the conductive rod, the insulating sleeve having a second slot through which the conductor contacts the conductive rod. The conductive rod may be rotated to apply the conductor to the conductive rod.

The device may also include a template formed on the wire for reducing a strain on the wire (e.g., when the conductor is connected to the conductive rod), a termination connected to the conductive rod, for electrically connecting the device to a source/target device, and a cap for rotating the conductive rod, the cap being formed on an end of the conductive rod.

The template may provide a guide for cutting insulation around the conductor so that a user knows, for example, how much insulation to cut around the conductor to expose the proper amount of conductor to be inserted into the conductive rod. The template may also provide a rotating stop mechanism so that the conductive rod is rotated by a desired amount.

The conductor may be inserted into the first slot so that, when the conductive rod is rotated, the conductor is applied or wound around the conductive rod. The first slot may also have an edge (e.g., an abrupt edge) to help apply the conductor to the conductive rod. In addition, the conductor may be compressed between the insulating sleeve and the conductive rod.

Further, the conductive rod may include a metal or non-metal conductive material. The rod may have a cylindrical, elliptical or other cross-sectional design. The rod may, thus, be tubular or have other multifaceted or flat planar surfaces and include a metal conductive device termination (e.g., to connect the device to another (e.g., source/target) device. In addition, the conductive rod and device termination may be plated with one or more conductive plating materials. Further, the contact area between the conductive rod and the conductor of the wire may be greater than a cross-sectional area of the termination.

In addition, the inventive device may be used to connect a wire having a plurality of conductive layers. For example, the wire may include at least one elongated conductor having a width of 0.125 inches or more and comprising at least one conductive layer having a thickness in a range of 0.0004 and 0.0200 inches, a bonding material between the conductors, and an insulation layer surrounding the conductors and bonding material. In addition, the thickness of the wire may be about 0.050 inches or less.

Further, the insulating sleeve may have a roughened outer surface and may be transparent, translucent or opaque and/or color-coded or otherwise differentiated by surface or molded indicator. In addition, the insulating sleeve may also include an open end for inserting the conductive rod, and a partially-open end to allow the insulating sleeve to expand, for example, to allow a conductor to be applied or wound around the conductive rod.

Further, the rotating cap may have the same color and texture as the insulating sleeve, and may be formed of the same material as the insulating sleeve. The rotating cap may also include an indicator for visually displaying to a user, a degree of rotation of the rotating cap.

In a second aspect of the present invention, an inventive method of connecting wire (e.g., insulated wire) includes inserting a conductor of a wire into a conductive rod, inserting the conductive rod into an insulating sleeve, and rotating the conductive rod to apply (e.g., wind and compress) the conductor around a surface of the conductive rod. The method may also include applying a strain relief and application template to the wire.

In the inventive method, the conductor may be compressed between the insulating sleeve and the surface of the conductive rod. Also, the contact area between the applied conductor and conductive rod may be greater than the cross sectional area of the termination affixed to the conductive rod.

With its unique and novel features, the present invention provides a tight, stable wire connecting device and method. The inventive device provides a large surface area for contact to minimize contact electrical or electromagnetic signal resistance. Further, the inventive device helps to ensure that a contact pressure is evenly applied over the surface area of the conductive rod and conductor of the wire. In addition, the contact area provided by the inventive device is substantially air-tight to enhance resistance to corrosion of the conductive rod of the inventive device or conductors to which is applied. Furthermore, the resulting contact is also very durable and resistant to mechanical failure because of the secure connection provided by the inventive device.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
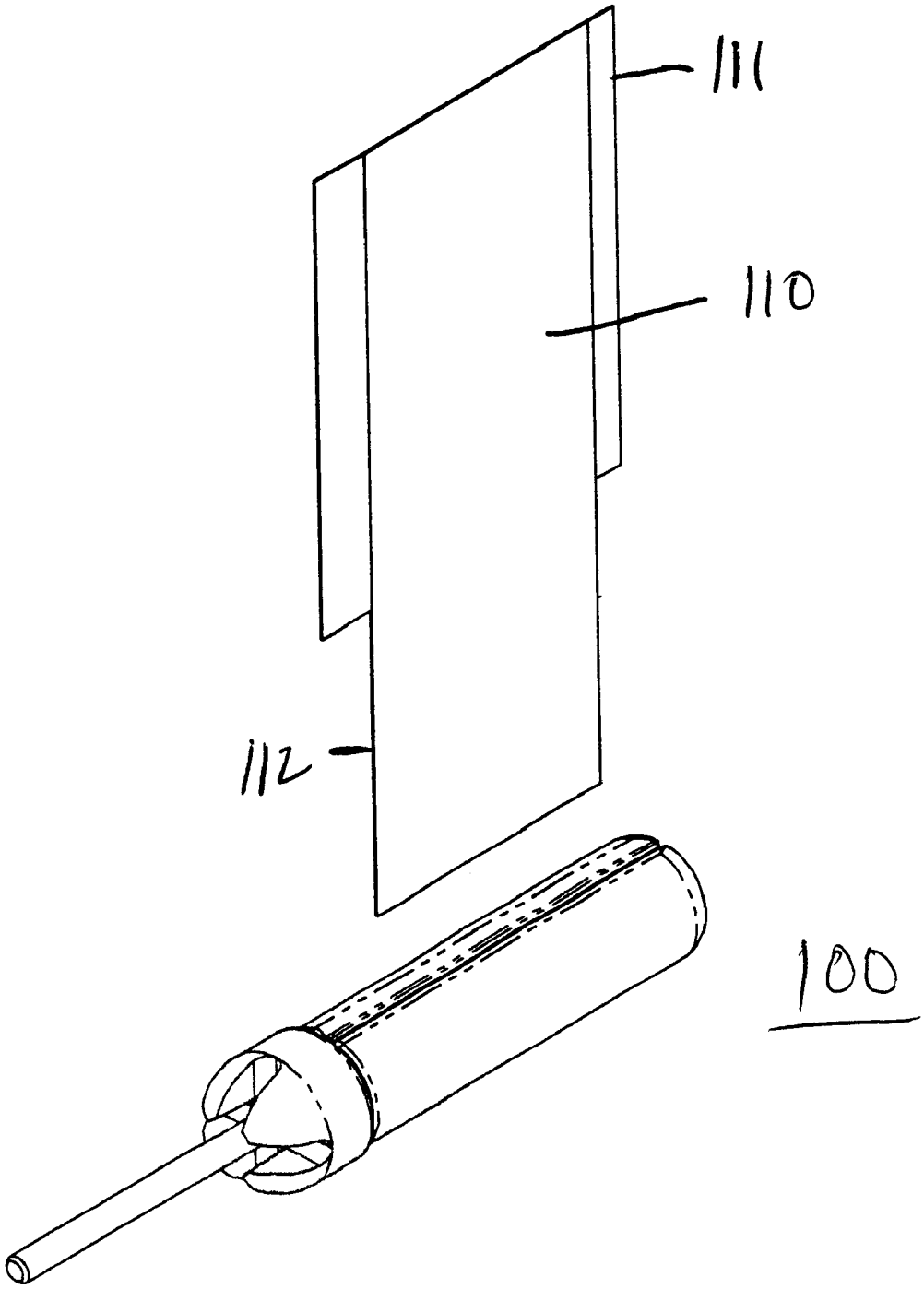
FIG. 1 is an illustration of a device 100 for connecting wire according to the present invention.

Referring now to the drawings, FIG. 1 illustrates a device 100 for connecting wire according to the present invention. For example, as shown in FIG. 1, the inventive device 100 may be used to connect a wire 110 (e.g., an insulated flat wire) having a conductor 112 (e.g., at least one conductor) and an outer insulation layer 111 to another device such as a conventional appliance or device (e.g., a source/target device).

Specifically, the inventive device 100 may be used to connect a wire (e.g., a plurality of wires) to another device or structure, for example, for transmitting or receiving a transmission. An advantage of the inventive device 100 is that it may maintain the impedance and other electromagnetic propagation characteristics of the wire through the connection. In other words, there is almost no contact resistance involved with the inventive device 100.

The inventive device 100 may be used to connect wire having various sizes and shapes. In other words, the inventive device 100 is not necessarily limited with respect to the size or shape of wire connected thereby. The wire may be, for example, an insulated wire having a conductor formed of a metallic, metallic alloy or conductive material and may be flexible. The conductor(s) of the wire should be of sufficient gauge and resilience to allow it to be safely used for its respective application. For example, the wire types may include speaker wire, phone wire, data wire, or wire for carrying, for example, standard household 110 volt AC electricity.

Figure 2:
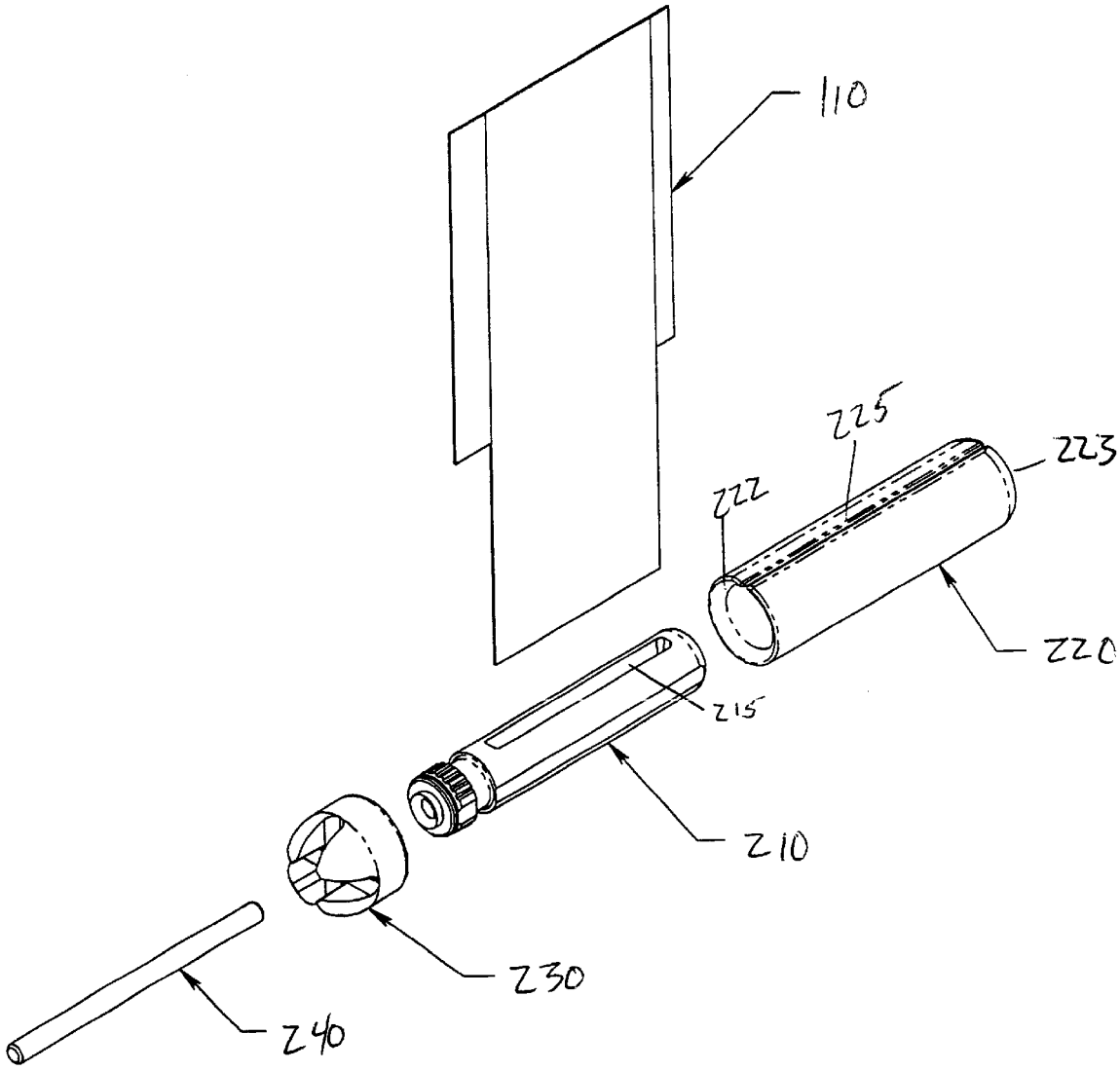
FIG. 2 illustrates an exploded view of the device 100 for connecting wire according to the present invention.

As shown in FIG. 2, the inventive device 100 may include a conductive connector barrel 210 (e.g., a conductive rod). The connector barrel 210 may be made, for example, of a conductive material or metal such as zinc. Further, the connector barrel 210 may also be plated (e.g., with a metal such as copper, nickel, or gold) to improve the characteristics of the connector barrel 210.

The connector barrel 210 may also have a basically cylindrical shape (e.g., have a circular cross-section), as shown in FIG. 2. However, the connector barrel 210 does not have to have a strictly cylindrical shape, but may be generally cylindrical and having flat sides. For example, the connector barrel 210 may have two flat sides on opposite sides of the connector barrel 210, as shown in FIG. 1. The connector barrel 210 may also have other shapes, such as an elliptical cross-section.

Further, the connector barrel 210 includes a slot 215 into which a conductor 112 (e.g., a plurality of conductors) of a wire 110 may be inserted. Therefore, when the connector barrel 210 is rotated, the conductor(s) 112 may be applied or wound so as to electrically connect the conductor(s) 112 and thereby the wire 110 to the connector barrel 210.

The slot 215 in the connector barrel 210 may thus have a length and width sufficient to insert the conductor(s) 112 (e.g., slightly longer and wider than the conductors), or a portion thereof, to be connected, and facilitate the application of the conductor(s) 112 of the wire when the connector barrel 210 is rotated. For instance, to facilitate the application of the conductor(s), the slot 215 may have a sharp edge at the outer surface of the connector barrel 210.

Further, the slot 215 may go through (e.g., all the way through) the center of the connector barrel 210. The inner walls of the slot 215 may also be plated (e.g., copper, nickel or gold plated) as with the connector barrel 210 generally.

Figure 3B:
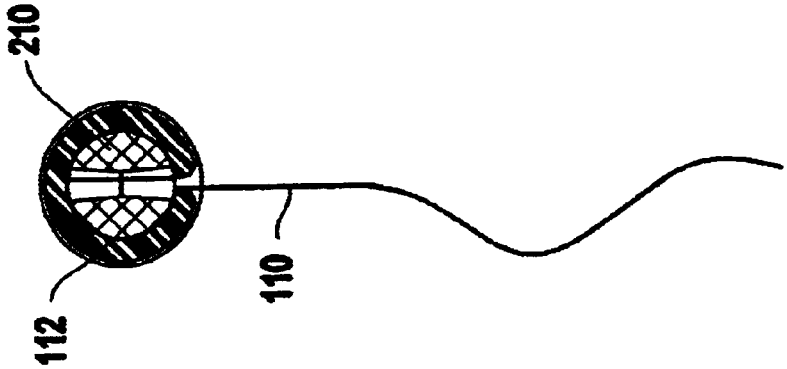
FIGS. 3A–3B illustrate the device 100 having a conductor of a wire inserted therein, and a cross-sectional view of the device 100 along lines I—I.
Figure 3A:
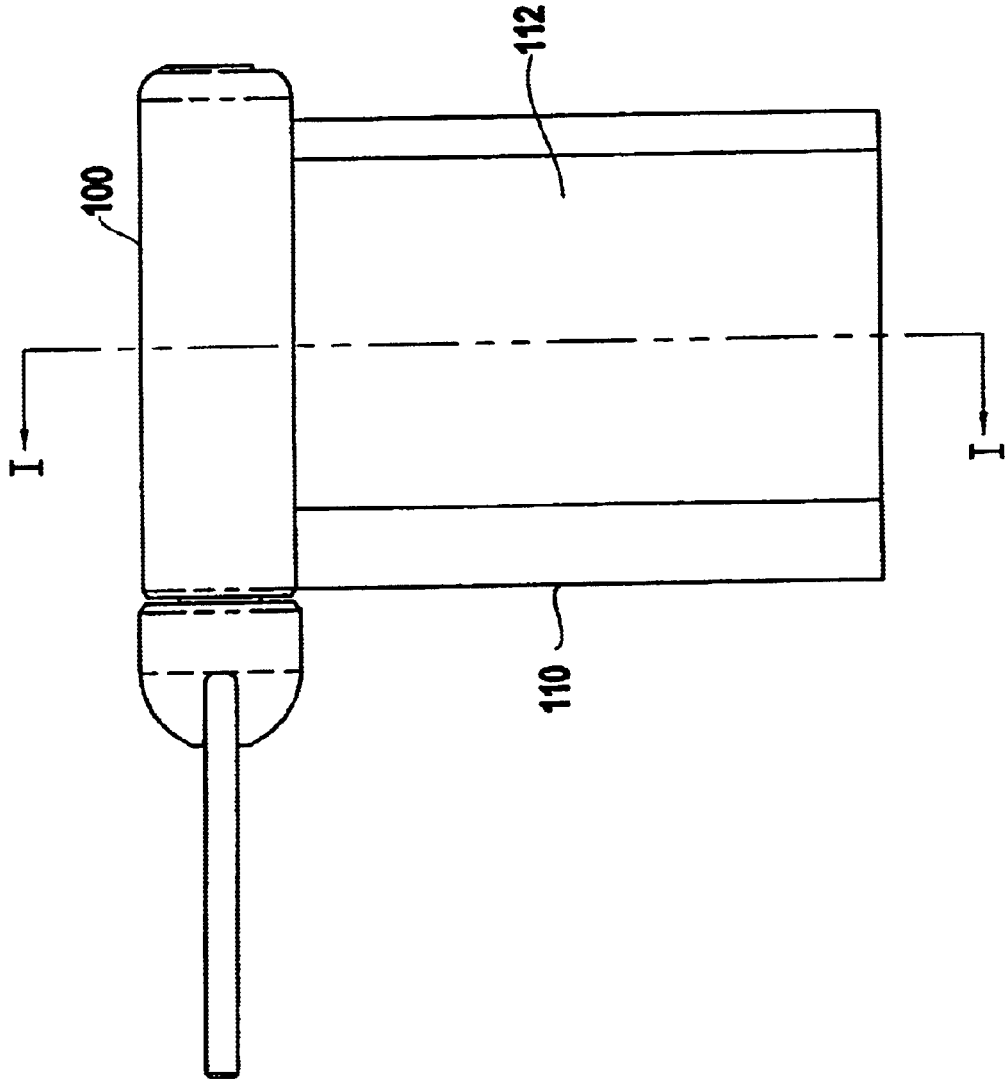

For instance, FIGS. 3A–3B illustrate the device 100 having a wire (e.g., a conductor 112 of a wire) inserted therein, and a cross-sectional view along lines I—I. In particular, the cross-sectional view of FIG. 3B shows the conductor 112 of a wire inserted into the inventive device 100 and applied around the connector barrel 210.

Referring again to FIG. 2, the inventive device 100 also includes an insulating sleeve 220. The insulating sleeve 220 may be substantially rigid (e.g., being only slightly bendable) and formed of many conventional electrically insulating materials. For example, the insulating sleeve 220 may be formed of a thermoplastic such as acrylonitrile butadiene styrene (ABS). In addition, the insulating sleeve 220 may be translucent to allow a user to see through the insulating sleeve 220 to the connector barrel 210 and conductor(s) 112 of the wire 110 contained therein. Further, the insulating sleeve 220 may be color-coded to indicate a characteristic (e.g., polarity, ground, etc.) of the conductor(s) 112 contained therein.

As shown in FIG. 2, the insulating sleeve 220 may have a shape generally of a hollow cylinder having one end 222 open (e.g., completely open) so that the connector barrel 210 may be inserted therein, and another end 223 which is only partially open. More specifically, the sleeve 220 may have a substantially cylindrical shape and have an inner diameter which is slightly larger than an outer diameter of the connector barrel 210 so that the insulating sleeve 220 may be slid onto the connector barrel 210 to provide an interference fit when conductor(s) are applied. Further, the insulating sleeve 220 should be long enough to cover the length of the connector barrel 210.

Figure 4C:
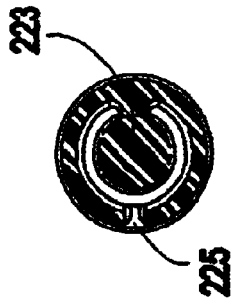
FIGS. 4A–4C illustrate the device 100 and opposing axial views of the device 100.
Figure 4B:
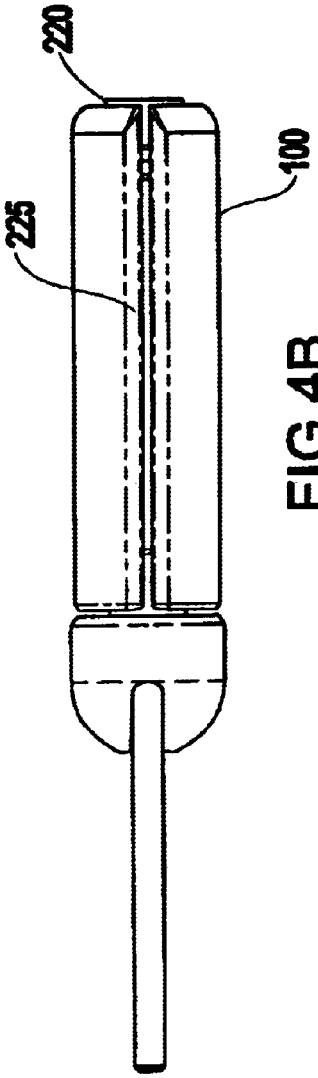
Figure 4A:
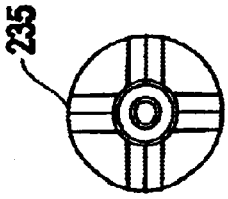

For instance, FIGS. 4A–4C illustrate the device 100 and opposing axial views of the device 100. Specifically, FIG. 4C provides an axial view (i.e., end view) of the partially open end 223 of the insulating sleeve 220. The partially open end 223 is not closed so as to allow the insulating sleeve 220 to expand to allow for the conductor(s) of a wire to be wrapped around the connector barrel 210 inside the insulating sleeve 220. The insulating sleeve 220 may also have an outer surface that is roughened (e.g., textured) to provide a better gripping surface for the user.

Further, the insulating sleeve 220 may compress the conductor(s) around the connector barrel 210. The inventors have determined that a flexible feature of the insulating sleeve 210 helps to ensure a high contact pressure between the conductor(s) 112 and the connector barrel 210. Further, the contact pressure may be uniform (e.g., constant) across the width of the conductor(s). Further, the high contact pressure and large surface contact area provided by the connector barrel 210 help to ensure that the inventive device 100 exhibits substantially zero contact resistance. Therefore, unlike conventional connectors, with the inventive device 100 there is no reduction in performance because of the connection.

In addition, the wall of the insulating sleeve 220 may have a thickness which is sufficient to provide electrically insulating qualities, and so the thickness may vary depending upon the particular application. In other words, for more powerful electrical applications, the walls of the insulating sleeve 220 may be thicker to provide better insulation, than for low power applications.

Further, as shown in FIGS. 4B–4C, the insulating sleeve 220 may include a slot 225 through which the conductor(s) of a wire may be connected to the connector barrel 210. For instance, the slot 225 may have a width comparable to a width of the slot 215 in the connector barrel 210. Further, as shown in FIG. 4B, the slot 225 may extend almost from one end of the insulating sleeve 220 to the other (e.g., from end 222 to end 223).

Thus, when the insulating sleeve 220 is slid onto the connector barrel 210, the conductor(s) of the wire may be inserted simultaneously into the slot 225 of the insulating sleeve 220 and the slot 215 of the connector barrel 210. The connector barrel 210 may then be wound to apply the conductor(s) 112 and tightly secure the conductor(s) in and around the connector barrel 210, in the inventive device 100.

Alternatively, the conductor(s) 112 may be inserted into the slot 215 in the connector barrel 210, the connector barrel may then be wound to apply the conductor(s) securely around the connector barrel and the connector barrel 210 may then be inserted into the insulating sleeve 220, with the connector barrel 210 oriented so that the conductor(s) are inserted into the slot 225 of the insulating sleeve. In other words, the connector barrel 210 may be inserted into the insulating sleeve 220 either before or after the conductor(s) are inserted into the connector barrel 210.

In fact, the insulating sleeve 220 may be slid onto the connector barrel 210 either before or after the connector barrel 210 is rotated to apply the conductor(s). For example, before the connector barrel 210 is inserted into the insulating sleeve 220, the user may apply the conductor(s) 112 around the connector barrel 210 using his hand or other device. On the other hand, the user may insert the connector barrel 210 into the insulating sleeve 220 and use the slot 225 and inside surface of the insulating sleeve to apply the conductor(s) around the connector barrel 210.

Further, as shown in FIG. 2, the inventive device 100 may also include a rotating cap 230 which is affixed (e.g., temporarily or permanently) to one end of the connector barrel 210. The rotating cap 230 may be employed by a user to facilitate easy rotation of the connector barrel 210. Specifically, by rotating the rotating cap 230, the user may easily rotate the connector barrel 210 either in or out of the insulating sleeve 220.

The rotating cap 230 may be formed of an electrically insulating material. For example, the rotating cap 230 may be formed of the same material as the insulating sleeve 220. Further, the rotating cap 230 may have similar characteristics as the insulating sleeve 220 (e.g., translucent, transparent, opaque, color-coding, outer diameter, etc.,) to provide a substantially uniform outer appearance to the inventive device 100. In addition, the rotating cap 230 may have a diameter larger than the diameter of the insulating sleeve 220 to provide a larger gripping surface for the user. Further, the outer surface of the rotating cap 230 may be roughened (e.g., include notches or grooves) to make it easier for a user to grip and turn the rotating cap 230.

Further, the rotating cap 230 may be affixed to the connector barrel 210 by adhesive (e.g., glue or epoxy) or may be merely tightly form-fitted so that no adhesive is required. In addition, the outer surface of the end of the connector barrel 210 onto which the rotating cap 230 is affixed, and/or the inner surface of the rotating cap 230 may be roughened (e.g., slotted or notched) to enhance the fit and prevent the rotating cap 230 from slipping on the connector barrel 210.

Further, FIG. 4A shows an axial view (e.g., end view) of the rotating cap 230. The rotating cap 230 may include an indicator 235 (e.g., slots, marks, etc.) to indicate to the user a degree of rotation (e.g., 90°) of the rotating cap 230. For example, a user may use the indicator 235 to control a degree of rotation of the rotating cap 230 so as to control application of the conductor(s) on the connector barrel 210.

Figure 5:
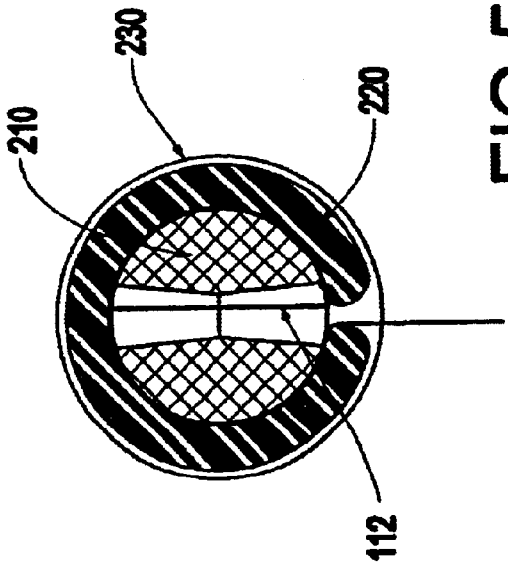
FIG. 5 illustrates a cross-sectional view of the device 100 along lines I—I and having a conductor of a wire inserted therein.

For example, FIG. 3B (and FIG. 5) illustrates a cross-sectional view of the device along lines I—I (e.g., see FIG. 3A). FIG. 5 (similarly to FIG. 3B) illustrates a larger cross-sectional view of the device 100 having a conductor 112 of a wire inserted therein. FIGS. 3B and 5, shows the rotating cap 230 having a larger diameter than the insulating sleeve 220, and the conductor 112 of a wire 110 being applied around the connector barrel 210. Specifically, FIGS. 3B and 5 illustrate an example where the rotating cap 230 has been rotated 360° (e.g., one complete turn) so that the conductor 112 of the wire 110 is around (e.g., completely around) the connector barrel 210.

Referring again to FIG. 2, the inventive device 100 may include a termination 240 (e.g., flat wire to conventional wire termination). The termination 240 may be used, for example, to connect the device 100 (e.g., connect the conductor of a wire inserted in the device 100) to another device such as an amplifier, a stereo tuner, or the like.

Specifically, the termination 240 may be formed of a strand of wire or conductor (e.g., an electrically conductive metal such as copper, silver alloys, or gold plated metals) or other standard interconnects, such as Banana Jacks, or RCA connectors. Further, the termination 240 may be connected to the connector barrel 210 (e.g., the end of the connector barrel 210). For example, the termination may be securely connected (e.g., permanently or temporarily) to the connector barrel 210 by crimping, soldering, welding, mechanical connection, or may be integrally formed with the contact rod 110 as one unit.

Further, the termination 240 may be formed of a thin wire (e.g., conductor) having a thickness (e.g., diameter) of about $^{80}/_{1000}$ inches. However, it should be noted that the thickness of the termination 240 may vary and may, for example, be dictated by the particular application of the device 100. For example, if the device 100 is used to connect wire to a stereo or phone line, the termination 240 may be substantially smaller than more powerful applications.

It should also be noted that the contact area between the surface of the connector barrel 210 and the conductor(s) of the wire connected thereby, may be substantially larger than the cross-sectional area of the termination 240. This may ensure, for example, that the inventive device 100 has almost no contact resistance and that there is no reduction in performance due to the connection.

The unique device 100 creates a greatly enhanced contact surface area. For example, the contact surface area for 110 V AC may range from 196 to 392 times greater than cross-sectional gauge area for solid core round wire. For example, a single conductive layer would be 392 times greater than cross-sectional gauge area for solid core round wire and two or more layers would be 196 times greater than cross-sectional gauge area for solid core round wire. This contact surface area may be varied, for example, by varying the width and number of layers of the wire conductor and the length and diameter of the connector rod barrel.

Figure 6A:
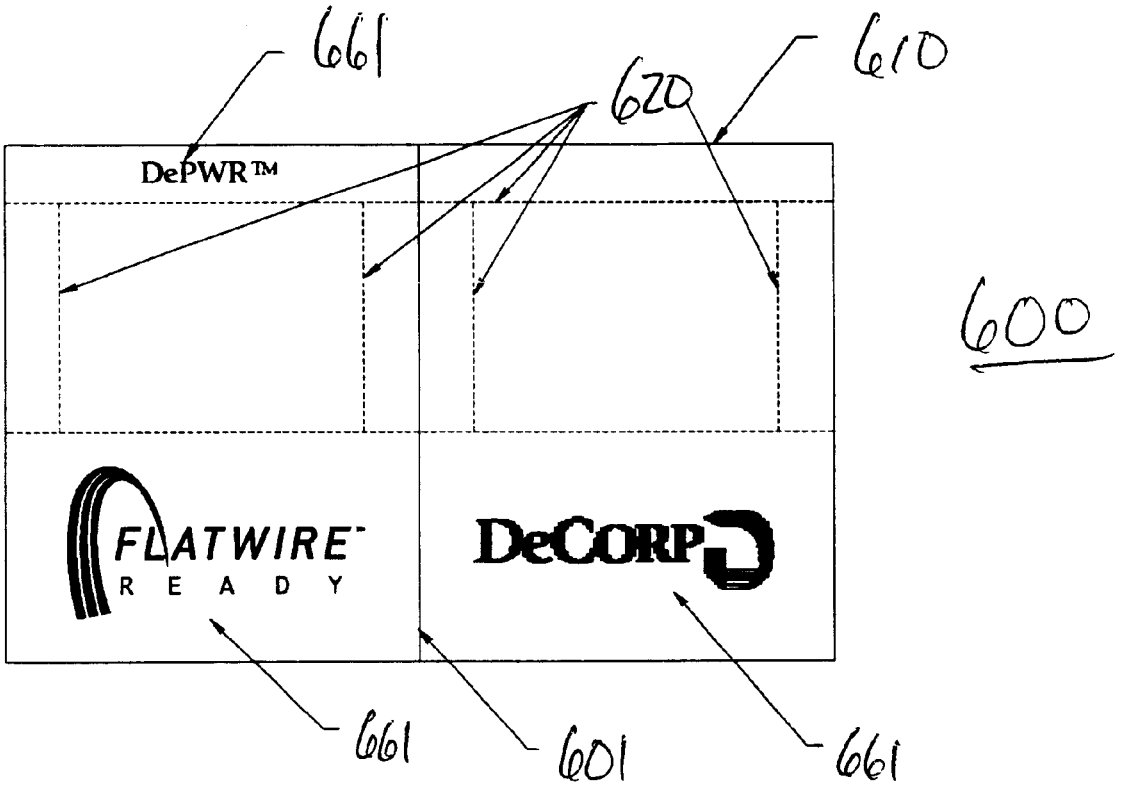
FIGS. 6A–6B illustrate a template 600, 650 for reducing a strain on wire to be inserted into the device 100.
Figure 6B:
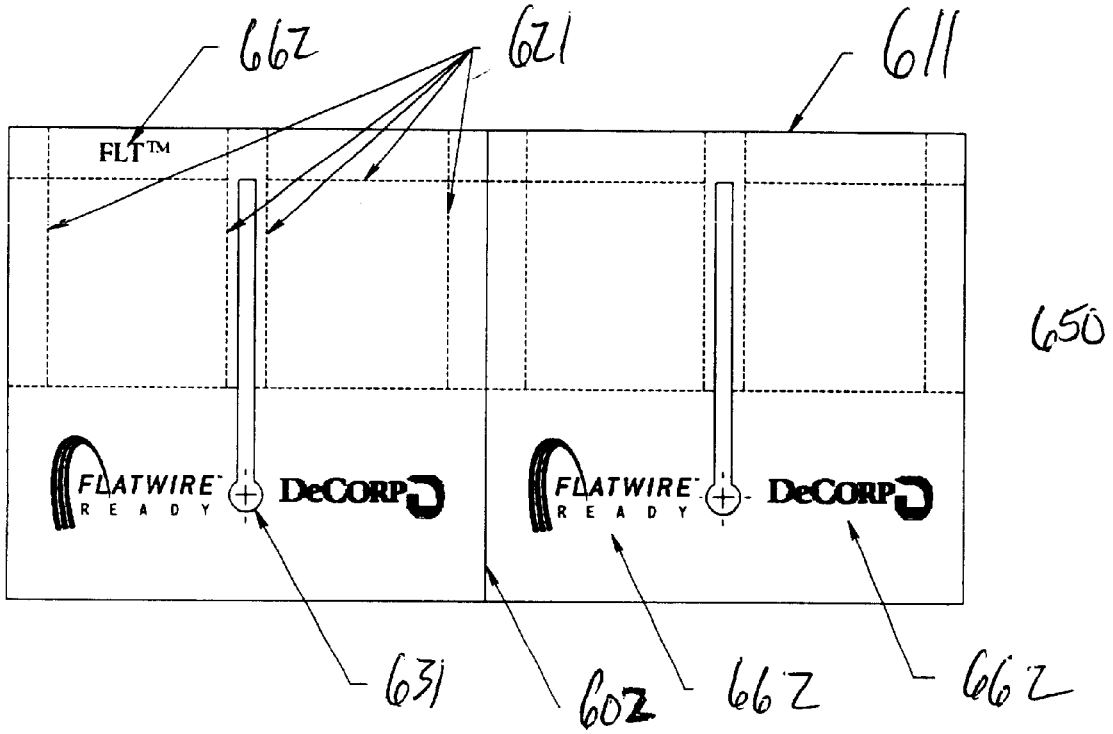

Referring now to FIGS. 6A–6B, the inventive device 100 may further include a template 600, 650 for stabilizing the wire (e.g., reducing a strain on the wire). Specifically, FIG. 6A illustrates a template 600 which may be used on wire (e.g., an insulated wire) having a single conductor and FIG. 6B illustrates a template 650 which may be used on for a wire (e.g., an insulated wire) having 2-conductors. The template 600, 650 may be secured to the wire (e.g., on the insulation) before the conductor(s) of the wire are inserted into the connector barrel 210. The template 600, 650 may be formed of a material (e.g., a plastic such as polyester film, etc.) and may be secured (e.g., by adhesive, bonding, fusing or the like) to the wire to be connected by the inventive device 100. For example, the template 600, 650 may be wrapped around the outside of an insulated wire and adhered to the insulation.

The template 600, 650 improves the durability of (e.g., provide strain relief to) the end of the insulation and wire which is to be inserted into the inventive device 100. For instance, the template 600 may help to prevent the end of the insulation surrounding the conductor(s) from tearing.

Further the template 600, 650, after it is applied to the wire, may serve to limit the amount of conductor(s) which may be wound or applied around the connector barrel 210.

Further, the template 600, 650 may provide a guide for cutting the insulation around the conductor(s)which is to be connected by the device 100. For instance, as shown in FIGS. 6A–6B, the user may fold the template along a fold line 601, 602 and align an end 610, 611 of the template 600, 650 with the end of the conductor(s) of the wire to be inserted into the device 100. A user may then use the indicators 620, 621 (e.g., lines) on the template 600, 650 to cut the template 600, 650 to peel back the insulation on the wire to expose a sufficient portion of the conductor(s) to be inserted into the device 100. In addition, as shown in FIG. 6B, the template 650 may include an indicator 631 for indicating where to cut the template 650 and insulation around the conductor(s) to provide sufficient movement to allow the user to work with the end of the wire. Further, the template 600, 650 may include other indicia 661, 662 (e.g., aesthetic indicia).

Figure 7:
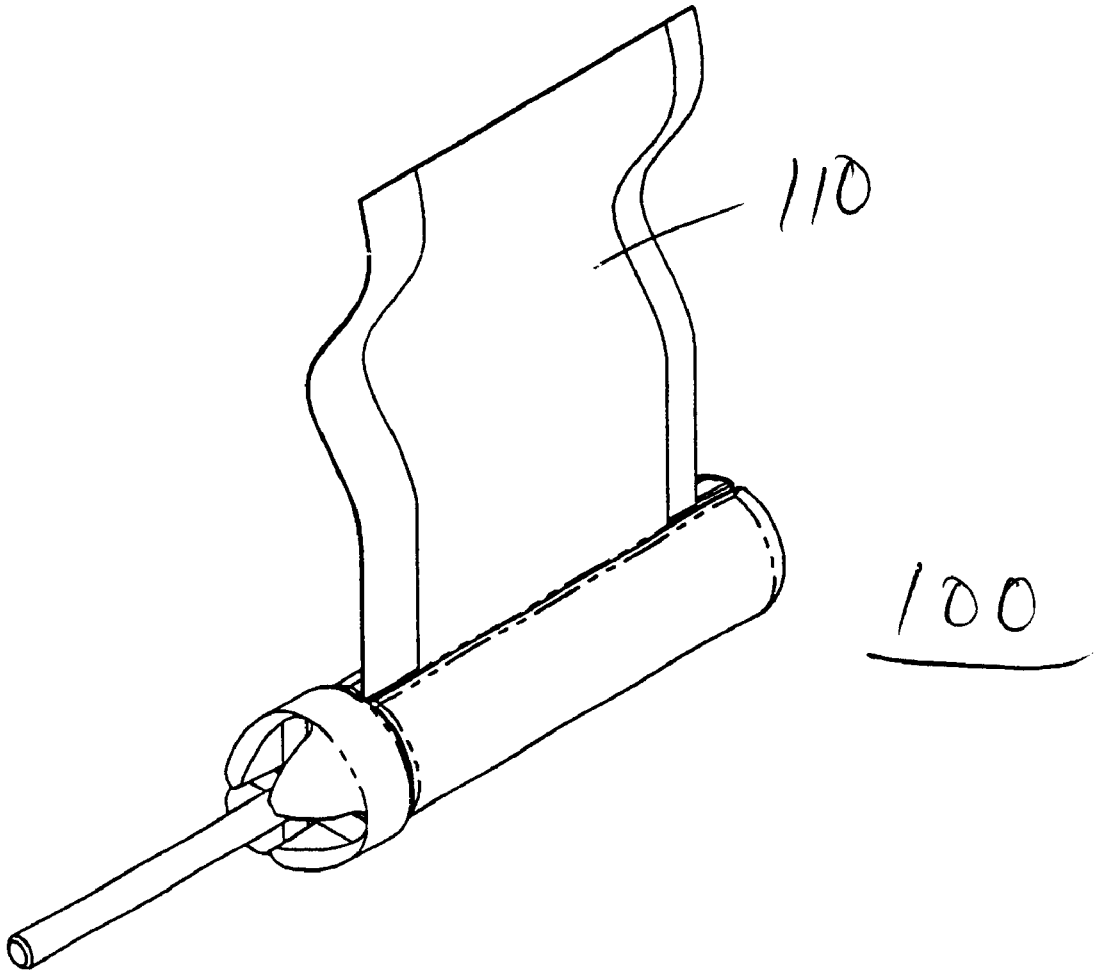
FIG. 7 illustrates the device 100 having a wire connected thereto.

Referring again to the drawings, FIG. 7 shows the inventive device 100 having a flat insulated wire 110 connected thereto. Specifically, the insulation around the conductor(s) in the wire 110 has been stripped back to expose the (e.g., conductor) inside the insulated wire 110 and the exposed conductor(s) has been inserted into the connector device. The device 100 may be used to connect a flat wire having a thickness of no more than about 0.050 inches. For example, the inventive device 100 may be used to connect the multipurpose wire disclosed in U.S. Pat. No. 6,107,577, which is incorporated herein by reference.

Further, such a flat wire may include a conductor (e.g., plurality of conductors) which is formed as a conductive layer (e.g., a plurality of conductive layers). For instance, the conductive layers may be stacked on top of each other so that they may be inserted together into one connector barrel 210 in the inventive device 100. More specifically, the conductive layers may each have a thickness of about 0.0004 to 0.020 inches (e.g., about 0.0020 inches), all of which is surrounded by a thin insulating film.

Further, the inventive device 100 may be used to connect a multiple-conductor (e.g., 2 conductor, 3-conductor, etc.) wire in a substantially parallel and co-planar arrangement, contained in one insulation film. As with a single conductor wire, each conductor may have a plurality of conductive layers which are substantially co-planar and parallel. For instance, the wire may include two substantially coplanar and parallel conductors, each conductor having two conductive layers stacked one on another.

Further, the conductors in a wire having a plurality of conductors may be inserted into a single device 110. Alternatively, each conductor may be connected by a separate device 100. In other words, each conductor may be inserted into a separate connector barrel 210 and insulating sleeve 220 so that each conductor is connected separately to another device.

In addition, the inventive device 100 may be used to connect a plurality of wires together. For example, the inventive device 100 may be used with or without the termination 240 so that the two separate lengths of wire may be connected, for example, to make one length of wire.

Figure 8:
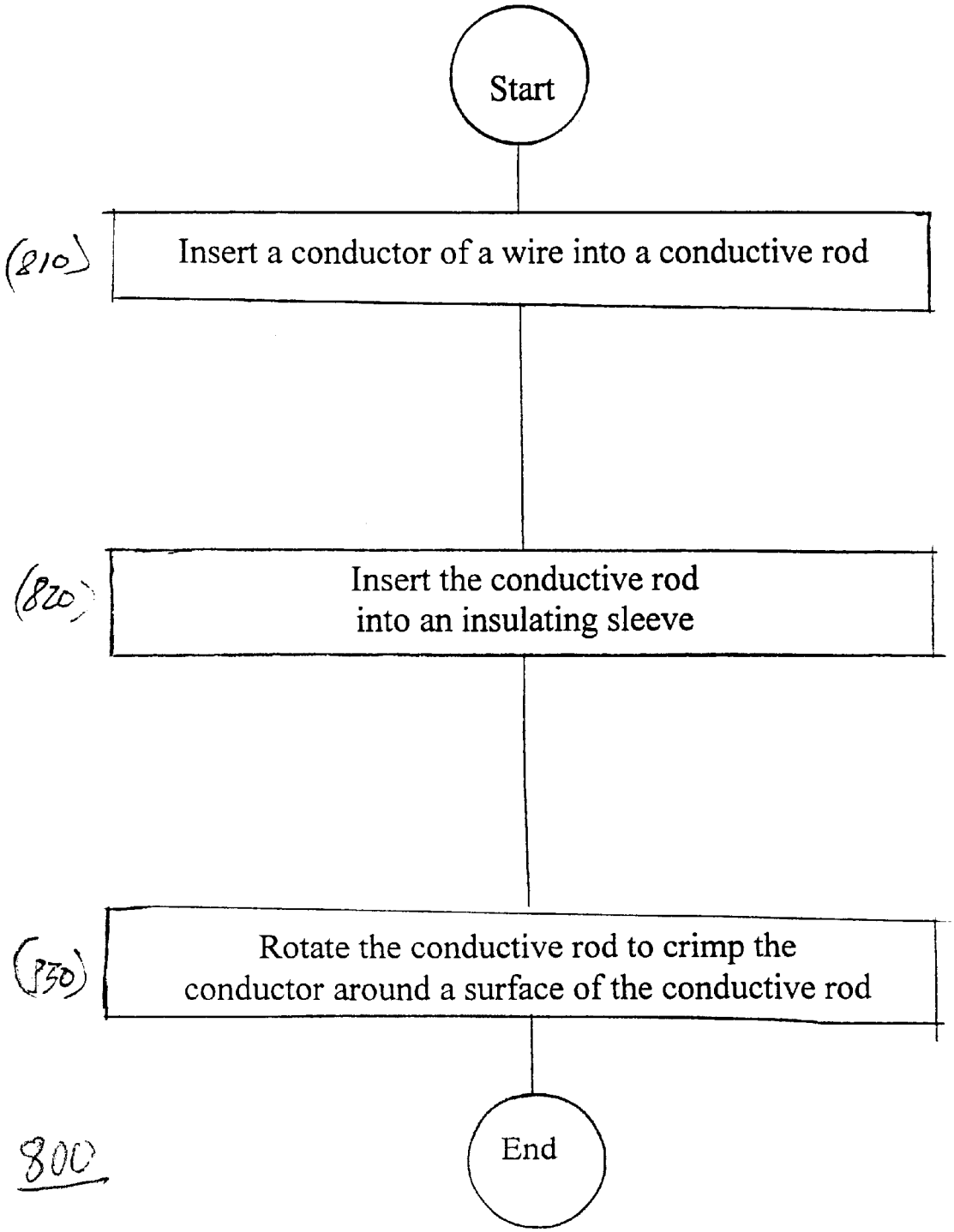
FIG. 8 is a flow diagram illustrating a method 800 for connecting wire according to the present invention.

Referring again to the figures, as shown in FIG. 8, the present invention also includes an inventive method 800 for connecting wire.

As shown in FIG. 8, the inventive method 800 uses a connecting device having a connector barrel and insulating sleeve. Specifically, the inventive method includes inserting (810) the conductor(s) of a wire into a slot in the connector barrel. The inventive method also includes rotating (820) the connector barrel to crimp the conductor(s) around the connector barrel and form an electrical connection. The inventive method 800 also includes inserting (830) the connector barrel into the insulating sleeve so that the conductor(s) contact the connector barrel through a slot in the insulating sleeve. The inventive method 800 may also include affixing a template over the wire to secure the wire during a connection.

Figure 9:
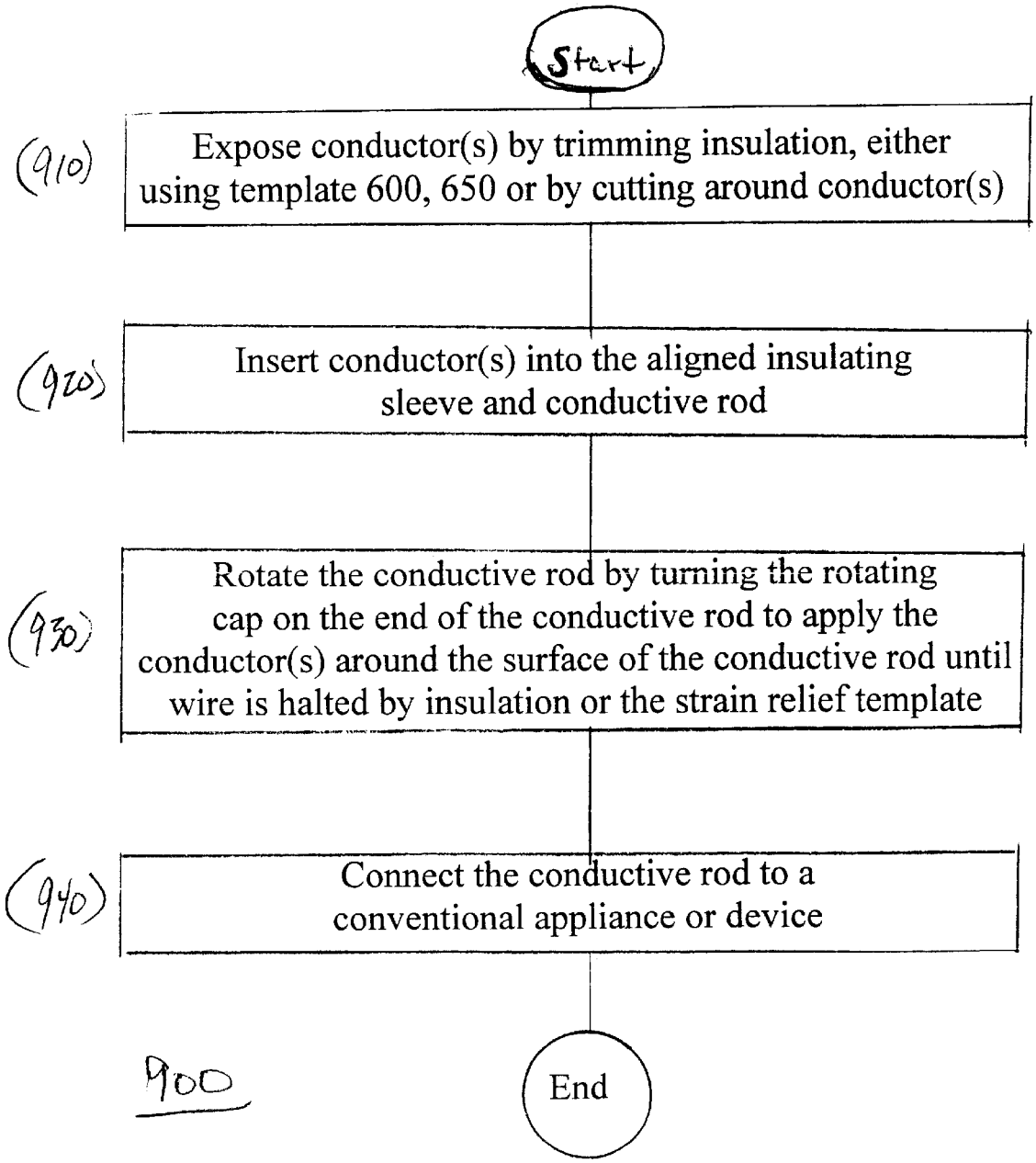
FIG. 9 is a flow diagram illustrating a first exemplary embodiment of the inventive method for connecting wire according to the present invention.

An exemplary embodiment of the inventive method is shown in FIG. 9. In this exemplary embodiment, a template may be formed over the wire to secure the wire. This embodiment also includes exposing (810) conductor(s) in the wire by trimming the wire insulation material either using template 600, 650 or by cutting around insulating material. The method may proceed by inserting (820) the conductor(s) into the aligned insulating sleeve slot and the conductive rod (e.g., connector barrel) slot. The electrical connection may be made by rotating (830) the conductive rod by turning the rotation cap on the end of said conductive rod to apply the conductor(s) around the surface of the conductive rod until the conductor(s) is halted by the wire insulation or the strain relief template around the until the template 600, 650 stops the rotation. The method may also include connecting (940) the conductive rod to an appliance or device (e.g., a conventional appliance or device).

Figure 10:
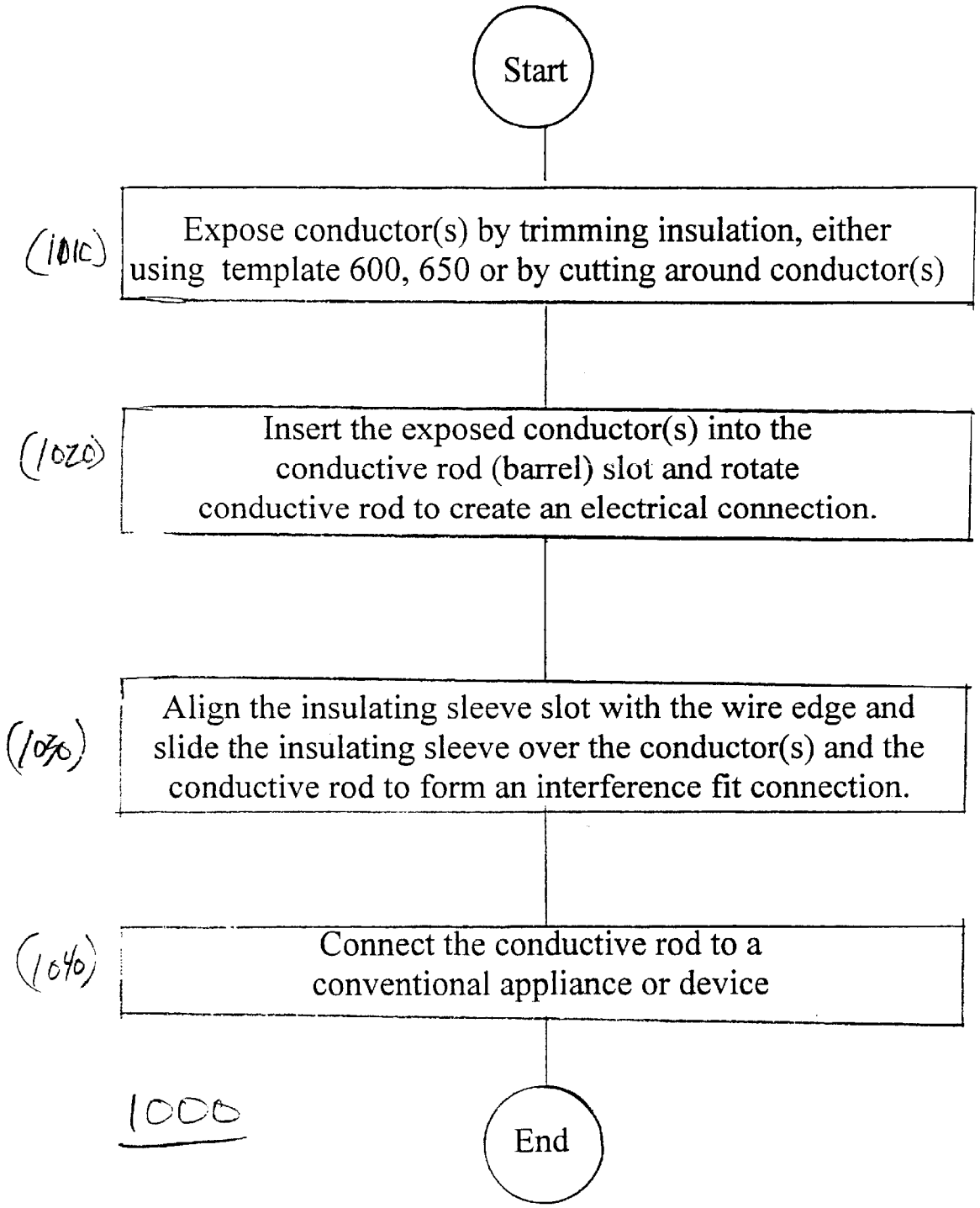
FIG. 10 is a flow diagram illustrating a second exemplary embodiment of the inventive method for connecting wire according to the present invention.

Another example of the inventive method is shown in FIG. 10. As shown in FIG. 10, the inventive method may include exposing (1010) conductor(s) in the wire by trimming the wire insulation material either using template 600, 650 or by cutting around insulating material, and inserting (1020) the exposed conductors into the connector barrel slot and rotating connector barrel to apply the conductor(s) to form an electrical connection. The method may proceed by aligning (1030) the slot in the insulating sleeve with the wire edge and sliding the insulating sleeve over the applied conductor(s) and conductive rod barrel to create an interference connection. The method may also include connecting (1040) the connector barrel (e.g., conductive rod) to an appliance or device (e.g., a conventional appliance or device).

Therefore, with its unique and novel features, the present invention provides a tight, stable wire connecting device and method. The inventive device 100 provides a large surface area for contact to minimize contact resistance. Further, the inventive device 100 helps to ensure that a contact pressure is evenly applied over the surface area of the connector barrel 210 and conductor(s). In addition, the contact area provided by the inventive device 100 is substantially airtight to enhance resistance or corrosion of the various components of the wires or conductors that are applied to the inventive device. Furthermore, the resulting contact is also very durable and resistant to mechanical failure because of the secure connection provided by the inventive device 100. This includes resistance to vibration and external pull forces which can cause subsequent loss of electrical contact. The inventive device 100 also maintains this large surface contact area over the life of the device. Furthermore the device can be reused many times over the life of the device such as when a user moves and rewires at a new location.

While the invention has been described in terms of preferred embodiments, those skilled in the art will recognize that the invention can be practiced with modification within the spirit and scope of the appended claims. For example, although the invention is shown herein connecting an insulated wire, the invention may also be used to connect non-insulated wire. Further, although the invention is shown herein connecting one wire and one conductor, it should be understood that the invention may be used to connect a plurality of wires and a plurality of conductors.

What is claimed is:

1. A device for connecting wire comprising:

a conductive rod having a first slot for inserting a conductor of said wire; and an insulating sleeve covering a portion of said conductive rod, said insulating sleeve having a second slot through which said conductor contacts said conductive rod; and a termination formed on said conductive rod, wherein a contact area between said conductor and said conductive rod is greater than a cross-sectional area of said termination.

2. The device according to claim 1, further comprising:

a template formed on said wire for reducing a strain on said wire and providing a guide for cutting insulation surrounding said conductor to expose a specific wire dimension, and providing a stop for rotating said conductive rod during a connection.

3. The device according to claim 1, wherein said conductive rod comprises one of a metal and non-metal conductive material.

4. The device according to claim 1, wherein said conductive rod comprises a conductive plating material.

5. The device according to claim 1, wherein said conductor comprises a plurality of conductors.

6. The device according to claim 1, wherein said conductive rod has one of a circular or elliptical cross-section.

7. The device according to claim 1, wherein said wire comprises a conductor having a thickness of no more than about 0.0200 inches.

8. The device according to claim 1, wherein said first slot has an edge so that when said conductor is inserted into said first slot and conductive rod is rotated, said conductor is applied around said conductive rod.

9. The device according to claim 1, wherein said insulating sleeve is one of transparent, translucent and opaque.

10. The device according to claim 1, wherein said insulating sleeve is color coded.

11. The device according to claim 1, wherein said insulating sleeve further comprises:

a first end which is open for inserting said conductive rod; and a second end which is partially-open to allow insulating sleeve to expand.

12. The device according to claim 1, wherein said insulating sleeve has a roughened outer surface.

13. The device according to claim 1, wherein said insulating sleeve expands to allow said conductor to be applied around said conductive rod.

14. The device according to claim 1, wherein said conductor is compressed between said insulating sleeve and said conductive rod.

15. The device according to claim 1, wherein said wire comprises:

at least one elongated conductor having a width of 0.125 inches or more and comprising at least one conductive layer having a thickness in a range of 0.0004 and 0.0200 inches;

a bonding material between each of said at least one elongated conductor; and an insulation layer surrounding said at least one elongated conductor and said bonding material, wherein a thickness of said wire is not greater than about 0.050 inches.

16. The device according to claim 1, wherein said electrical connection is formed across a width of said conductor.

17. The device according to claim 1, wherein said electrical connection is formed between a surface area of said conductor and said outer surface area of said conductive rod.

18. The device according to claim 1, wherein said electrical connection comprises a substantially uniform electrical connection.

19. The device according to claim 1, wherein a contact pressure between said conductor and said outer surface of said conductive rod is substantially uniform across a width of said conductor.

20. The device according to claim 1, wherein said conductor which is inserted into said conductive rod comprises a non-insulated conductor.

21. The device according to claim 1, wherein said termination connects said device to a source/target device.

22. The device according to claim 1, further comprising:

a rotating cap formed on an end of said conductive rod.

23. The device according to claim 22, wherein said rotating cap has a same color and texture as said insulating sleeve, and is formed of a same material as said insulating sleeve.

24. The device according to claim 22, wherein said rotating cap comprises an indicator for displaying to a user a degree of rotation of said rotating cap and the insulating sleeve.

25. A method of connecting wire, comprising:

inserting a conductor of said wire into a conductive rod;

inserting said conductive rod into an insulating sleeve; and rotating said conductive rod to apply said conductor around a surface of said conductive rod, wherein said conductor is applied to an outer surface area of said conductive rod to form an electrical connection between said conductor and said conductive rod, and wherein a contact area between said conductor and said conductive rod is greater than a cross-sectional area of a termination affixed to said conductive rod.

26. The method according to claim 25, further comprising:

applying a strain relief and application template to said wire.

27. The method according to claim 25, wherein said conductor is compressed between said insulating sleeve and said surface of said conductive rod.

28. A method of connecting wire, comprising:

applying a stain relief and application template to said wire.

inserting a conductor of said wire into a conductive rod;

rotating said conductive rod to apply said conductor to said conductive rod up to an edge of the strain relief and application template; and aligning said wire with a slot in an insulating sleeve and sliding said insulating sleeve over said conductor and conductive rod, wherein a contact area between said conductor and said conductive rod is greater than a cross-sectional area of a termination affixed to said conductive rod.

29. The method according to claim 28, wherein said aligning said wire is performed before said rotating said conductive rod.

* * * * *